United States Patent [19]

van der Lely

[11] 3,958,320

[45] May 25, 1976

[54] METHODS FOR THE MANUFACTURE OF PREFABRICATED BUILDING SECTIONS OR ROOM UNITS AND FACTORIES FOR THE IMPLEMENTATION OF SUCH METHODS

[76] Inventor: Cornelis van der Lely, 7, Bruschenrain, Zug, Switzerland

[22] Filed: Sept. 19, 1973

[21] Appl. No.: 398,867

[30] Foreign Application Priority Data

Sept. 19, 1972 Netherlands ..... 7212652

[52] U.S. Cl. ..... 29/430; 29/200 A

[51] Int. Cl.[2] ..... B23P 15/00; B23P 19/04; E04G 21/14

[58] Field of Search ..... 29/430, 200 A, 200 R; 52/741, 745, 747

[56] References Cited

UNITED STATES PATENTS

| | | | |
|---|---|---|---|
| 2,574,163 | 11/1951 | Bamford, Sr. | 29/430 |
| 2,993,265 | 7/1961 | Bernhard et al. | 29/200 A |
| 3,225,434 | 12/1965 | van der Lely et al. | 29/200 A |
| 3,399,445 | 9/1968 | Carroll | 29/430 |
| 3,555,763 | 1/1971 | Bloxom | 52/745 |
| 3,557,439 | 1/1971 | Dykeman | 29/430 |
| 3,574,920 | 4/1971 | Stirling et al. | 29/430 |
| 3,611,533 | 10/1971 | Thomason | 29/469 |
| 3,685,129 | 8/1972 | Jureit et al. | 29/430 |

*Primary Examiner*—C. W. Lanham
*Assistant Examiner*—Dan C. Crane
*Attorney, Agent, or Firm*—Mason, Mason & Albright

[57] ABSTRACT

A method and factory for making prefabricated parallelipiped configured sections which are transported to a building site where they are joined to form completed buildings. The factory is an elongated building wherein at one end metal frameworks and beams for floor, wall, ceiling and roof panels are made and rust-proofed. Next, a plurality of paths are provided for manufacture of the panels by delivering concrete material fill within the frameworks, cast in situ at least for the floor panels. The panels are then introduced into a drying area where the concrete dries and hardens and the panels are connected to form basic structural sections and, by overhead cranes, such sections are placed in groups of five on conveyor tracts which include, in endless members, elements that move the groups of sections by pushing against the metal framework of the rearward sections — there being a framework-to-framework junction of sections with each group. From the drying area the groups of sections are moved by the conveyor track to an assembly area which has a continuing similar conveyor track and storage facilities for plumbing and electrical supplies, wall coverings, insulation and the like and the groups of sections are moved from location to location in the assembly area for finishing operations. Finally, at the end of the factory building, the completed sections are displaced one by one by a further conveying track operation to a location from whence each section may be transported to the building site or to a storage area.

32 Claims, 19 Drawing Figures

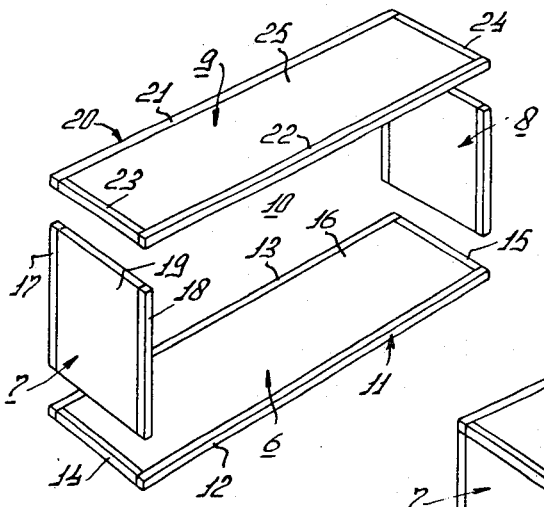
FIG. 3
FIG. 4
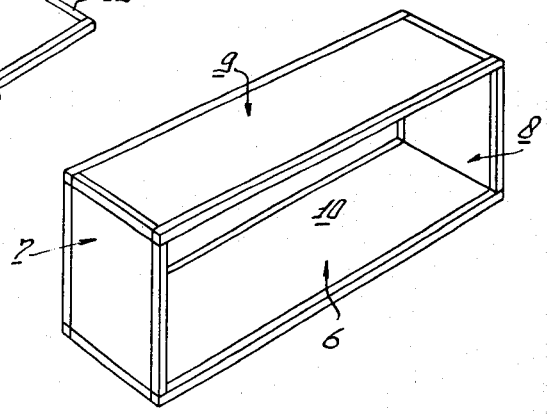
FIG. 5
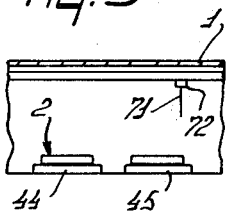
FIG. 6
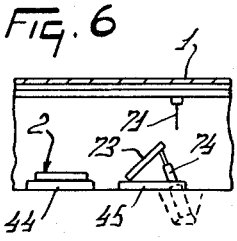
FIG. 7
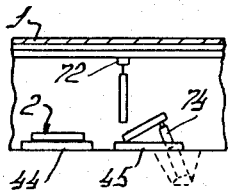
FIG. 18
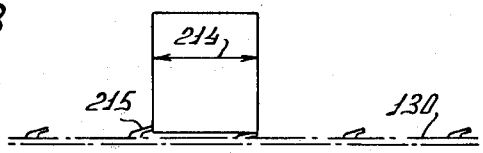
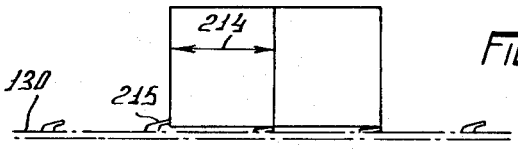
FIG. 19

58
70
82
84
80
83
204
205
206
207
208
101
149
102
125
103
131
210
136
133
101A
102A
103A
123
138
139
124

101
102
103
133
131
XI
XII
X
130
139
100
101A
109
108
107
106
172
171
102A
143
141
138
103A
209
210

FIG. 14
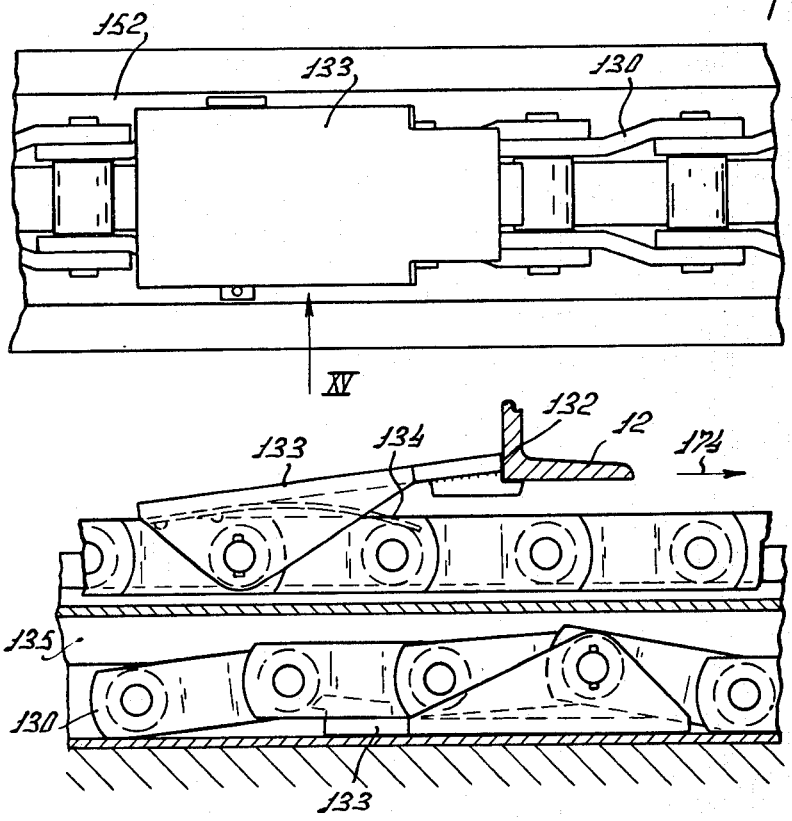
FIG. 15
FIG. 13
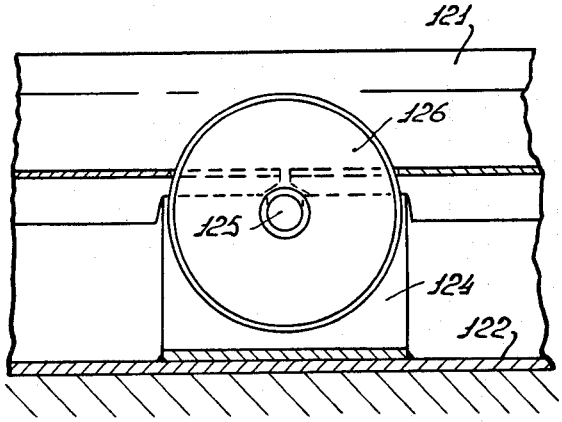

METHODS FOR THE MANUFACTURE OF PREFABRICATED BUILDING SECTIONS OR ROOM UNITS AND FACTORIES FOR THE IMPLEMENTATION OF SUCH METHODS

This invention relates to methods for the manufacture of prefabricated building sections and to factories for the implementation of such methods.

According to one aspect of the invention, there is provided a method for the manufacture of prefabricated building sections on a production line, the method comprising the steps of assembling prefabricated panels in an assembly station of said line to bring the sections to an at least basically completed structural condition and employing an intermittently movable conveying mechanism to move such sections from the assembly station to an assembly part of said line in which finishing operations are performed, said sections being moved continuously through at least one area of said assembly part.

For a better understanding of the invention, and to show how the same may be carried into effect, reference will now be made, by way of example, to the accompanying drawings, in which:

BRIEF DESCRIPTION OF THE DRAWINGS

FIG. 3 is an exploded diagrammatic perspective view of a prefabricated building section that may be constructed by a method in accordance with one aspect of the invention, FIG. 4 corresponds to FIG. 3 but shows the building section in an assembled condition, FIG. 5 is a section, to an enlarged scale, taken on the line V—V of FIG. 1, FIG. 6 corresponds to FIG. 5 but shows certain parts in alternative positions, FIG. 7 corresponds to FIG. 6 but illustrates a production stage subsequent to that shown in FIG. 6.

FIG. 13 is a section taken on the line XIII—XIII of FIG. 12, FIG. 14 is a plan view as seen in the direction indicated by an arrow XIV in FIG. 10, FIG. 15 is an elevation as seen in the direction indicated by an arrow XV in FIG. 14, FIG. 18 is a diagrammatic elevation illustrating a variation of a conveying mechanism for the building sections, and FIG. 19 corresponds to FIG. 18 but shows the mechanism employed in conveying two building sections.

DESCRIPTION OF THE PREFERRED EMBODIMENT

Figure 1:
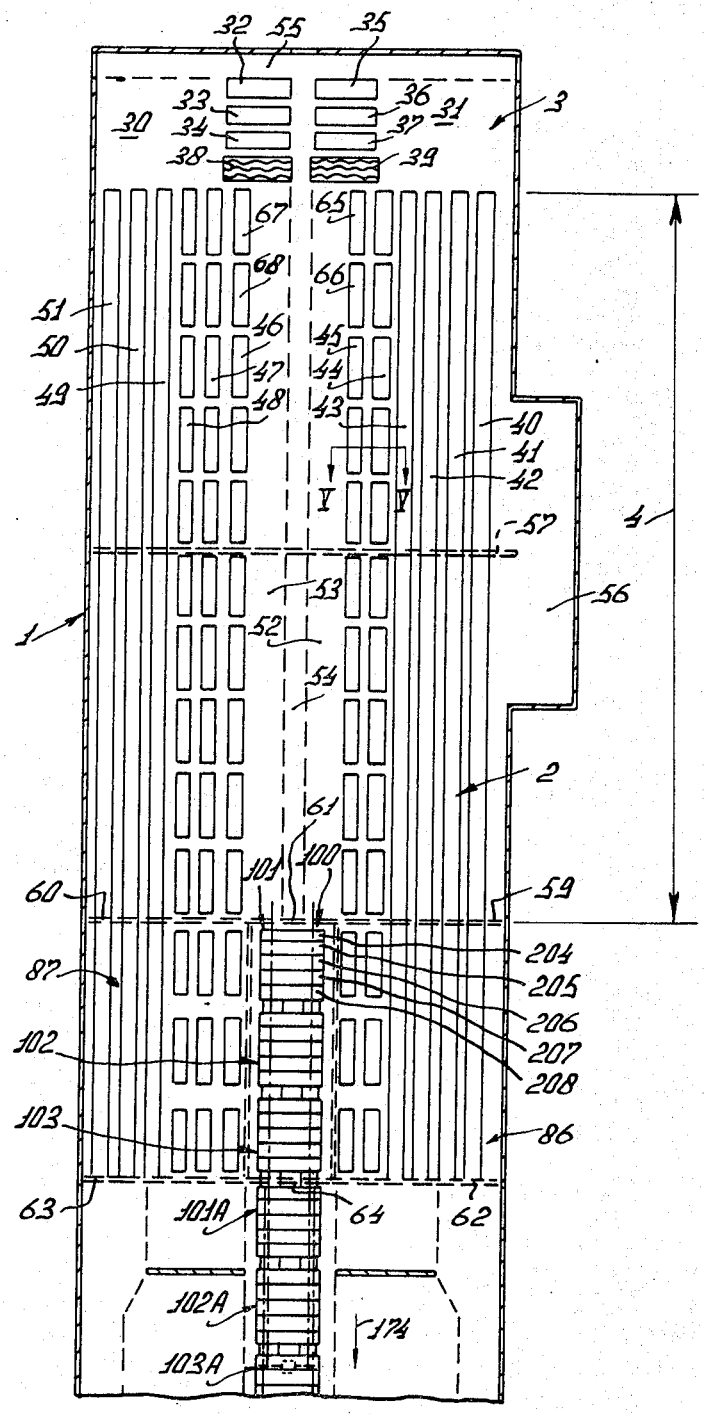
FIG. 1 is a diagrammatic plan view of a factory and shows a first part of a production line in accordance with one aspect of the invention.
Figure 2:
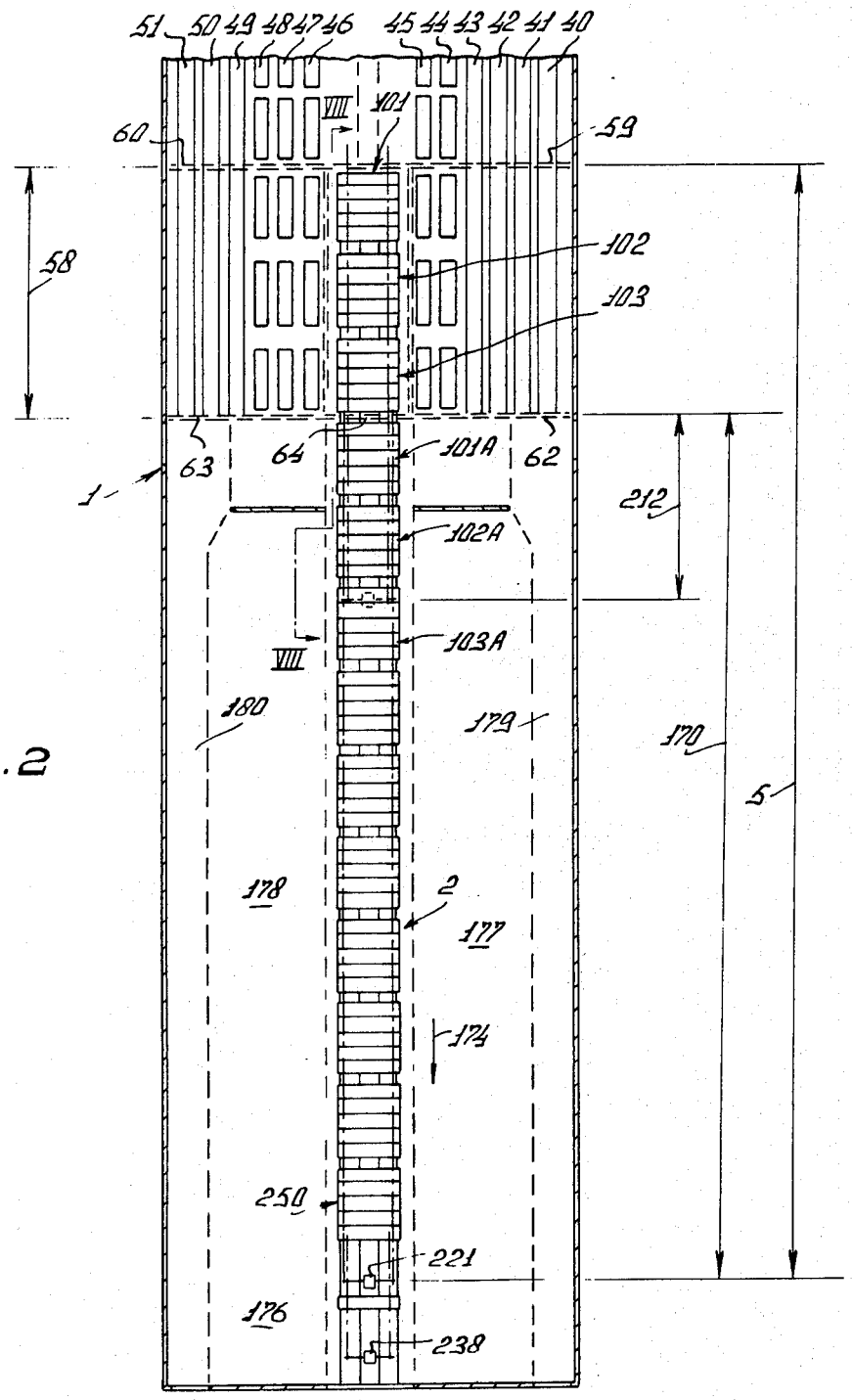
FIG. 2 is a plan view showing a further adjoining part of the production line illustrated in FIG. 1.

Referring firstly to FIGS. 1 and 2 of the drawings, those Figures illustrate a hall 1, forming part of a factory, in which hall a production line 2 is arranged. The production line 2 comprises a construction part 3, a manufacturing part 4 and an assembly part 5. The panels that are to form walls, floors, ceilings and so on of the building sections are made in the parts 3 and 4 of the line 2 and are then assembled at the beginning of the part 5 of that line. The assembled building sections are subject to further finishing techniques as they pass towards the end of the assembly part 5 of the production line 2 so that, when they reach said end, the sections are substantially complete and finished and are ready for use in the construction of prefabricated buildings.

A prefabricated building section 10 (FIGS. 3 and 4 of the drawings) that may be made on the production line 2 is comprised principally by a floor panel 6, two wall panels 7 and 8 and a panel 9 for the ceiling or roof. When the four panels 6 to 9 inclusive are assembled as shown in FIG. 4 of the drawings, the section 10 has the shape of a horizontally elongated rectangular parallelepiped, two opposite longer vertical side of which are missing. It is emphasized that the particular shape shown diagrammatically in FIGS. 3 and 4 of the drawings is by no means essential and that other shapes are possible depending upon the particular requirements of a building that is to be constructed. FIGS. 3 and 4 of the drawings do not show internal walls or other partitions of the section 10 but, in most cases, such internal walls or partitions will be provided during the prefabrication in the factory hall 1 together, where appropriate, with items of equipment such as kitchen equipment, sanitary ware and the like. The floor panel 6 has an oblong frame 11 of metal beams which is comprised by two longer parallel beams 12 and 13 and two shorter parallel beams 14 and 15 which beams are perpendicularly welded to each other at the four corners of the frame 11. The interior of the frame 11 is filled by at least on slab 16 that is formed wholly or principally from concrete. It is, in fact, possible to provide upper and lower slabs in the frame 11 with a spacing between them.

Each of the two wall panels 7 and 8 comprises two opposite vertically extending parallel beams 17 and 18 between which at least one slab 19 made principally from concrete is provided. The ceiling or roof panel 9 comprises an oblong frame 20 formed from two longer parallel horizontal metal beams 21 and 22 and two shorter parallel horizontal metal beams 23 and 24, the beams 21 to 24 being perpendicularly welded to one another at the four corners of the frame 20. It will be apparent that the construction of the frame 20 is generally similar to that of the frame 11, the frame 20 being filled by at least one slab 25 which may be made wholly or principally from concrete or from some other material that will serve satisfactorily as the basic ceiling of a room or other space. If the panel 9 is also to serve as part of the roof of the building in which the section 10 is to be employed, then the frame 20 also includes an additional roofing portion which is not shown in the drawings.

The metallic frames, such as the frames 11 and 20, are made in the construction part 3 of the production line 2 and those frames are used, in the manufacturing part 4, to make the panels such as the described panels 6 and 9. The construction part 3 of the production line 2 is provided with six welding jigs 32, 33, 34, 35, 36 and 37 in which the metal beams are joined to one another to make the various frames that are required. The beams themselves are cut to the required lengths in areas 30 and 31 (FIG. 1) and the assembled frames will normally be dipped into liquids contained in two tanks 38 and 39 to render the metal corrosion-resistant or otherwise to provide the metal with a rust-proof coating.

The manufacturing part 4 of the production line 2 comprises two parallel paths each of which is subdivided into six side paths. As can be seen in FIG. 1 of the drawings, one of the main paths comprises six side paths 40, 41, 42, 43, 44 and the other main path comprises six side paths 46, 47, 48, 49, 50 and. Each of the twelve side paths extends throughout the length of the manufacturing part 4 of the line 2 and comprises a plurality of jigs that are arranged in a row for the construction of the various panels such as the panels 6 to 9 inclusive that have been described. The four side paths 40 to 43 inclusive and the three side paths 49 to 51 inclusive all comprise jigs for the making of wall panels such as the wall panels 7 and 8. The jigs in question are constructed in such a way as to enable the beams 17 and 18 to be arranged therein so that the slabs 19 can be cast between them. The jigs are, however, preferably adjustable in such a way that internal walls and other partitions of the building sections can be made therein, such internal walls and partitions usually having dimensions which will differ from those of the panels 7 and 8. The jigs also make provision for furnishing the wall panels that are formed therein with door frames, window frames and the like. The metal beams 17 and 18 and any other required wall beams are brought to the appropriate jigs from the cutting areas 30 and 31 by way, when required, of the respective tanks 38 and 39. The side paths 44, 47 and 48 are all provided with jigs for the construction of the floor panels 6.

Before pouring the liquid concrete for the formation of the floor panels 6 or the wall panels 7 and 8, metallic mesh or other concrete-reinforcing elements can be provided between the corresponding beams and can be secured to those beams where necessary. Oblong frames, such as the frames 11 and 20, can be placed on drying plates 65, 66, 67 and 68 in the side paths 45 and 46 after being dipped in the tanks 38 and 39, said plates 65 to 68 inclusive constituting temporary storage areas for the frames in which drying can take place prior to their use in forming the required panels. The side paths 45 and 46 are provided with jigs in which the ceiling or roof panels 9 are made by connecting to the frames 20, the ceiling and roof material. The necessary materials are supplied to the side paths 45 and 46 from the storage areas 52 and 53. The areas 52 and 53 are situated along a path 54 which is lying in the extension of the production line 2.

The concrete that is required for making the slabs 16 and 19 (and also the slabs 25 if concrete is selected as the material for those slabs) is mixed in an area 56 at one side of the hall 1 and substantially midway along the length of the manufacturing part 4 of the production line 2. A conveyor belt 57 extends across the hall 1 from the mixing area 56 and is used to carry semi-liquid concrete, ready for pouring, to the twelve side paths of the manufacturing part 4. The semi-liquid concrete is discharged from the belt 57 into filling trays or other receptacles which are then manually or otherwise moved to the various jigs of the side paths at which the concrete is required.

Four conveying tracks are arranged above the manufacturing part 4 of the construction line 2 and can be used to carry metal beams, frames and concrete between various points in the hall 1 as may be required. The tracks actually cover the whole of the length of the construction part 3, the manufacturing part 4 and a drying region 58 (FIG. 8) of the hall 1. The drying region 58 is located beyond the manufacturing part 4 of the line 2 with regard to the direction of progress along the production line 2 during the use of that line. Each conveying track has a width which is substantially equal to the width of three neighboring side paths and comprises track rails 70 (FIG. 8) along which an overhead crane bridge 72 (FIGS. 5, 6 and 7) can travel. Each crane bridge 72 carries a mobile trolley 71 and, since the bridges 72 are movable lengthwise along the rails 70 over the production line 2 while the trolleys 71 are movable along the bridges 72 in directions substantially perpendicular to the length of the line 2, any required point in the general area under rails 70 can be reached by crane hoists that are carried by the trolleys 71.

Each of the side paths 40 to 51 inclusive extends beyond the manufacturing part 4 of the line 2 into the drying area 58 and these extensions of the side paths constitute storage spaces for the various panels that have been prefabricated in the side paths. The storage spaces may be heated by, for example, hot, humid air with a view to accelerating the hardening of the concrete or the setting of any other castable materials that may be employed. It will be realized that any panels which include concrete slabs must have that concrete hardened to a sufficient extent to avoid damage before the panels concerned are removed from their jigs. It is possible to speed up the hardening process by incorporating chemical accelerators in the concrete mix and by transporting the semi-liquid concrete to the castening jigs in a hot condition. Appropriate heating means may accordingly be provided in the concrete mixing area 56 so that the concrete may be transported to the casting jigs in a hot condition by conveyor belt 57 or crane bridges 72. A partition is formed between the manufacturing part 4 of the line 2 and the drying region 58 by three walls 59, 60 and 61. The walls 59 and 60 that extend respectively across the side paths 40 to 45 inclusive and 46 to 51 inclusive are both removable to give access to the drying region 58 from the delivery end of the manufacturing part 4 of the line 2. The wall 61 that is located between the walls 59 and 60 is, however, a fixed wall. The end of the drying space 58 that is remote from the walls 59 to 61 is closed by three further walls 62, 63 and 64 but, in this case, the walls 62 and 63 are fixed walls while the wall 64 that is located between them is a movable wall. It can be seen from FIG. 8 of the drawings that the drying region 58 of the factory hall 1 has a higher roof than the region of the factory hall 1 that contains the manufacturing part 4 of the line 2. Three conveyors 80, 81 and 82 are located just beneath the roof of the drying region 58 and each of them comprises track rails that extend substantially perpendicular to the length of the production line 2. The conveyors 80, 81 and 82 are located at a level above the manufacturing part 4 of the production line 2 which is substantially twice the height of the level of the track rails 70 thereabove and each of the conveyors 80, 81 and 82 comprises a corresponding crane bridge 83 having a hoist 84.

The conveying means that is afforded by the conveyors 80, 81 and 82, the crane bridges 83 and the hoists 84 enables prefabricated panels stored in drying areas 86 and 87 of the drying region 58 to be moved to the center of that region at which point an assembly station 100 is provided. The assembly station 100 is located at the beginning of the assembly part 5 of the production line 2 and, at said station 100, the various panels 6, 7, 8 and 9 are brought together and interconnected in correct positions to produce the required building sections 10. In the example which is being described, the sections are made in groups and, during the assembly operations, the sections of each group are temporarily joined to one another. As illustrated in the drawings, the assembly station 100 contains three groups 101, 102 and 103, each group comprising five building sections. For example, as illustrated, the group 101 comprises five sections 204, 205, 206, 207 and 208. The group 101 is assembled by arranging the five floor panels 6 of each of the sections 204 to 208 inclusive in the assembly station and by interconnecting those panels in side-by-side relationship. The required wall panels 7 and 8 and, usually, further panels affording internal walls or other partitions are then erected on, and are secured to, the interconnected floor panels 6. The ceiling/or roof panels 9 are then assembled on, and are connected to, the upper edges of the wall panels 7 and 8 and those of any internal walls or other partitions.

The building sections of a group are preferably so chosen that, if a dwelling is to be provided, the group of sections affords the complete dwelling or a complete story of a dwelling. In the example which is being described, each group of five sections or units affords a bungalow but could equally well be an apartment or flat. A plurality of building sections could, as an alternative, be assembled in juxtaposed relationship to form a large office and, under these circumstances, up to sixteen building sections may be marshalled together in the assembly station 100.

Figure 9:
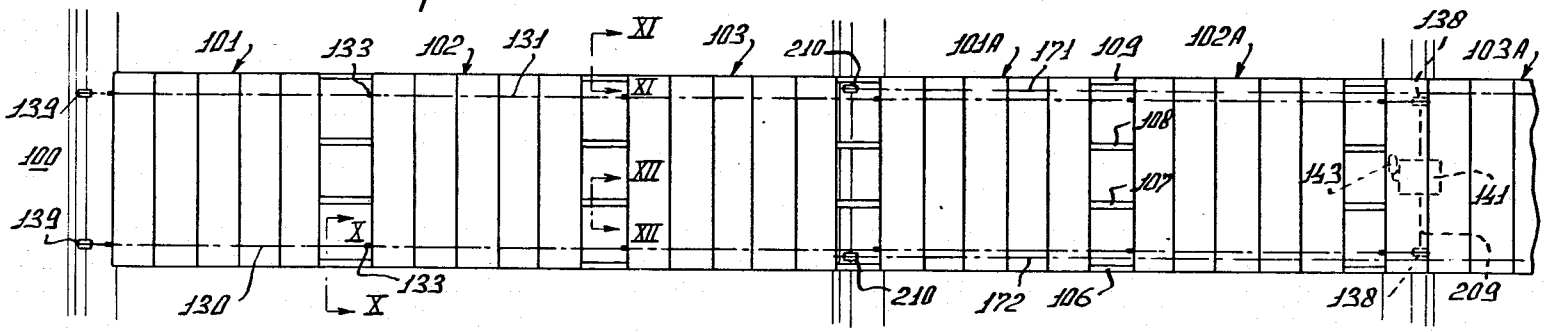
FIG. 9 is a plan view corresponding to FIG. 8.
Figure 17:
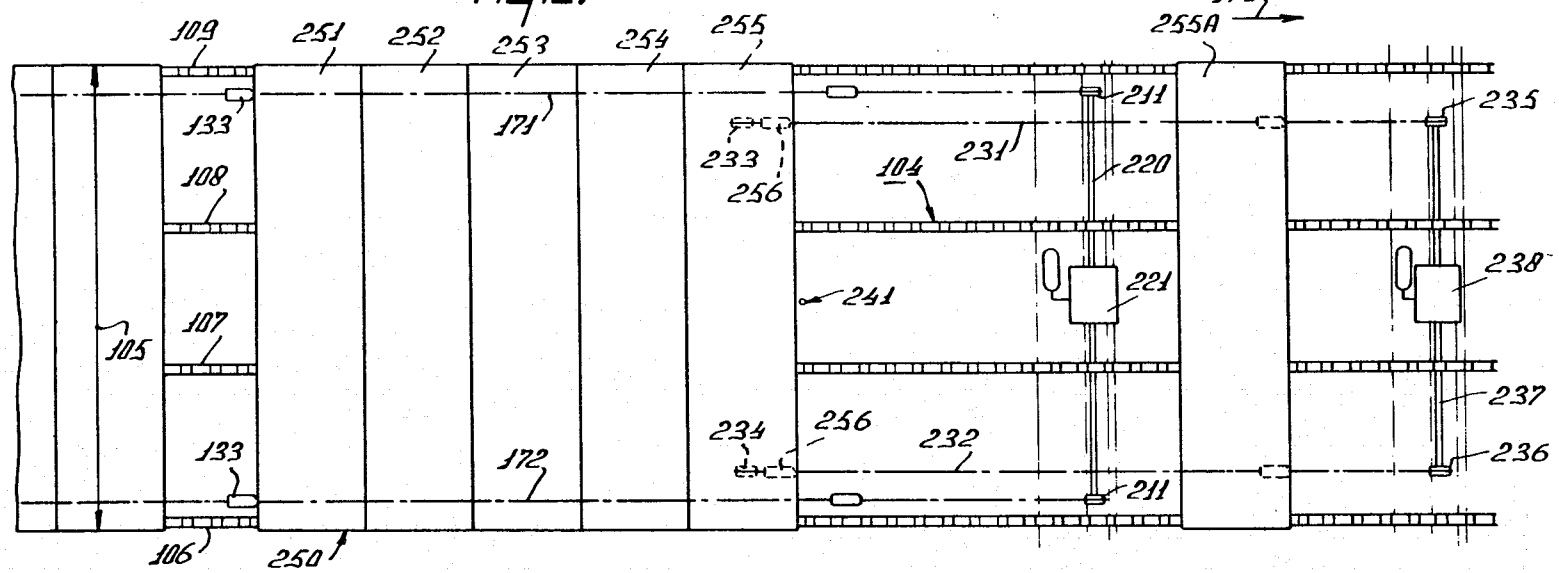
FIG. 17 is a plan view corresponding to FIG. 16.

The assembly part 5 of the production line 2 comprises a roller track 104 (FIG. 17) which affords a supporting track for the building sections and which commences in the assembly station 100. The roller track 104 comprises four individual tracks 106, 107, 108 and 109 (FIGS. 9 and 17 of the drawings) that extend parallel to one another and are regularly spaced apart. The group of roller tracks 106 to 109 which collectively are the supporting roller track 104 has its outermost two tracks 106 and 109 perpendicularly spaced apart from one another by a distance which is approximately equal to the length 105 (FIG. 17) of one of the elongated building sections that are supported by the roller track 104. Each of the building sections is of elongated oblong configuration when seen in plan view having two longer parallel sides and two shorter parallel sides which latter are spaced apart from one another by the distance 105 which has just been mentioned. These shorter parallel sides rest upon the outer tracks 106 and 109 while the tracks 107 and 108 support intermediate central regions of the building sections. Each of the tracks 106 to 109 inclusive extends throughout the complete length of the assembly part 5 of the production line 2.

Figure 10:
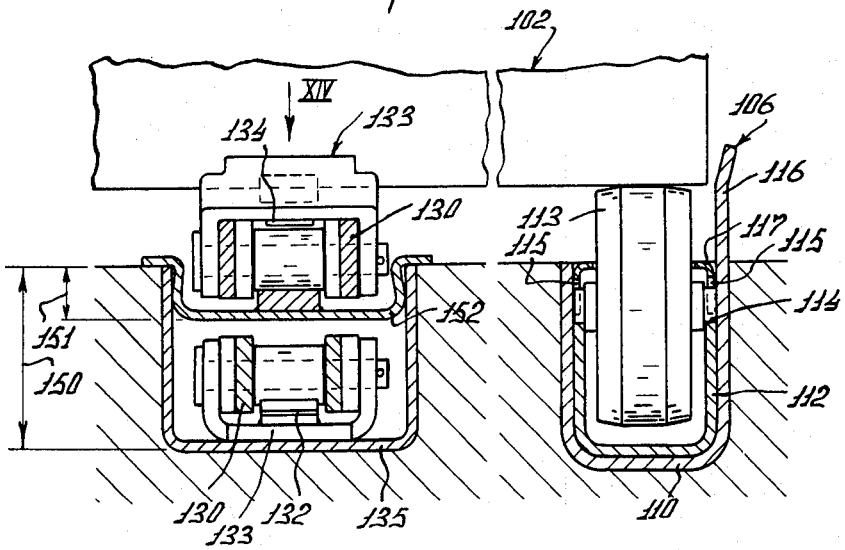
FIG. 10 is a section, to an enlarged scale, taken on the line X—X of FIG. 9.
Figure 11:
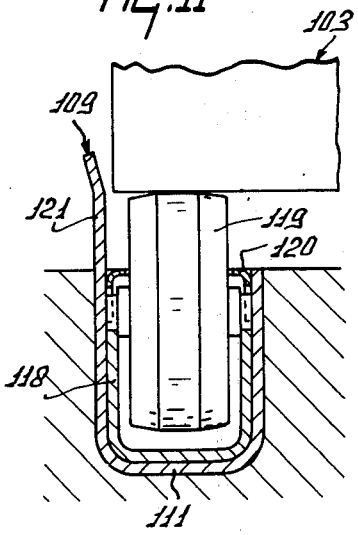
FIG. 11 is a section, to an enlarged scale, taken on the line XI—XI of FIG. 9
Figure 12:
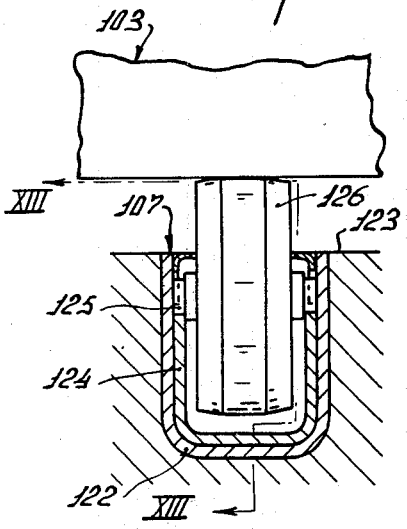
FIG. 12 is a section, to an enlarged scale, taken on the line XII—XII of FIG. 9.

The track 106 comprises a metal rail 110 (FIG. 10) of channel-shaped cross-section that is recessed into the floor of the hall 1 with substantially vertical limbs. Supporting members 112 are provided at regular intervals along the interior of the rail 110 and are formed at their tops with recesses 115 which receive shafts 114 affording the axes of rotation of corresponding rollers 113. With this arrangement, each roller 113 can readily be removed from its supporting member 112, or can be again connected thereto, merely by lifting that roller and its shaft 114 from, or dropping it back into, the corresponding recess 115. The side of the rail 110 that is outermost with respect to the whole roller track 104 has an upright guide rim 116 that projects above the factory hall floor level and above the tops of the rollers 113 to a position where its upper region will prevent incorrect lateral displacement of the building sections such as those of the group 102 that is shown in FIG. 10 of the drawings. The top of the channel-shaped metal rail 110 is closed, between the rollers 113 and their supporting members 115, by cover plates 117. The track 109 of which the details are shown in FIG. 11 of the drawings is symmetrically opposite in construction to the track 106 that has just been described. The track 109 comprises a metal rail 111 of channel-shaped cross-section, a plurality of regularly spaced apart supporting members 118 for corresponding rollers 119, cover plates 120 that extend between the rollers 119 and an upright guide rim 121 that is located symmetrically opposite to the guide rim 116 at the opposite side of the roller track 104 in such a way as to prevent undesirable lateral displacement of the building sections, such as those of the group 103 that can be seen in FIG. 11. The two tracks 107 and 108 are identical, and are similar to the tracks 106 and 109 that have just been described. The track 107 that is shown in FIGS. 12 and 13 of the drawings comprises a metal rail 122 of channel-shaped cross-section that is set into the factory hall floor in such a way that none of it projects above the surface 123 of that floor, that is to say, no parts equivalent to the guide rims 116 and 121 are provided. Once again, a plurality of supporting members 124 are provided at regularly spaced apart intervals along the rail 122 and each supporting member 124 rotatably carries a shaft 125 affording the axis of rotation of a corresponding roller 126.

The assembly part 5 of the production line 2 is provided throughout a distance 136 (FIG. 8) with conveying mechanisms in the form of conveying chains 130 and 131. These chains 130 and 131 are arranged between the tracks 106 and 109 of the supporting roller track 104, said distance 136 being twice the length of the assembly station 100 in which is located, as shown in the drawings, the three groups 101, 102 and 103 of the building sections. The conveying mechanism that is afforded by the chains 130 and 131 extends beyond the assembly station 100 over a distance equal to the length of that station so that any given number of sections that may be contained in the assembly station 100 at any time, whether or not they are brought together into groups, can be conveyed out of the station 100 by the chains 130 and 131 to a further region of the assembly part 5 in which subsequent finishing operations are performed upon the building sections. Assembly station 100 is thus completely cleared to receive a fresh batch of panels for assembly to form further building sections. The two conveying chains 130 and 131 afford a pick-up conveying mechanism and are substantially identical to one another. Accordingly, only details of the chain 130 and the parts that are associated therewith are shown in FIGS. 10, 14 and 15 of the drawings.

The chain 130 is disposed in a metal-walled recess 135 of channel-shaped cross-section in the floor of the factory hall 1, said recess receiving, in an upper region thereof, a second shallower channel 152. The recess 135 has a depth 150 but the channel 152 has a depth 151 which is equal to only about one-quarter of the depth 150. That portion of the recess 135 which is located beneath the channel 152 receives the return run of the endless chain 130 whereas the upper operative run of that chain is located at the top of the recess 135 inside the channel 152. The chain 130 is guided through 180° curves around return rollers or sprockets 138 and 139 (FIGS. 8 and 9 of the drawings) at the opposite ends of its upper and lower runs. The rollers or sprockets 138 are secured to a shaft 209 that is caused to rotate by a hydraulic motor 141. The driving system of the motor 141 incorporates an accumulator 143 in order that the motor 141 may readily be able to bring the loaded chains 130 and 131 into motion from rest.

Each of the chains 130 and 131 is provided with a number of abutments 133 having stops 132 (FIG. 15) at their free ends. Each abutment 133 is mounted so as to be pivotable about the axis of a pin interconnecting two links of the corresponding chain but is subject to the action of a leaf spring 134 which tends to maintain the abutment 133 concerned in the upwardly inclined position shown in FIG. 15 of the drawings while the associated portion of the chain 130 or 131 is in the upper "operative" run of that chain. The stops 132 are shaped to fit the lower edges of, for example, the metal frame beams 12 of the floor panels 6 of the various prefabricated building sections as is shown in FIG. 15 of the drawings. In the return runs of the chains 130 and 131, during which said chains bear against the bottoms of the channel-shaped recesses 135, the leaf springs 134 are overcome so that the flat surfaces of the abutments 133 that are remote from the links of the chain concerned bear slidably against the upper surfaces of the bottoms of said recesses 135. This disposition can be seen in FIG. 15 of the drawings in respect of one abutment 133 carried by the chain 130. As previously mentioned, both of the chains 130 and 131 carry a number of the abutments 133, said abutments being aligned with one another in a horizontal direction that is perpendicular to the intended direction of operative travel 174 (FIGS. 15 and 17 of the drawings) of the upper runs of the two chains. The distance between successive abutments 133 on each of the two chains 130 and 131 is equal to the length in the direction 174 of one group of building sections plus the distance in the same direction between two neighboring groups. The distance in question is indicated by the reference 149 in FIG. 8 of the drawings. It is, however, emphasized that the distance 149 is not a permanently fixed distance and that it can be adjusted, when required, to take account of groups of building sections that comprise more or less than the five such sections which form the groups 101, 102 and 103 shown in the accompanying drawings. To this end, the abutments 133 can be disconnected from the chains 130 and 131 and reconnected thereto with different spacings between them in the direction 174. It will be appreciated that the number of abutments 133 can be increased or decreased, as required, in this way to match the groups of building sections that are formed in the assembly station 100. It is, in fact, possible to provide the chains 130 and 131 with a large number of abutments that are spaced apart from one another by a distance which is equal to the width 214 (FIGS. 18 and 19 of the drawings) of one of the prefabricated sections. With such an arrangement, regardless of the sizes of the groups of building sections, at least one abutment, such as the abutment 215 that is shown in FIGS. 18 and 19 of the drawings, will always engage the rear of the group concerned with respect to the direction 174. At least two abutments will, with such an arrangement, lie beneath at least one building section that is being displaced by the chains 130 and 131 and these abutments, which will be engaged from above by at least one frame beam of at least one floor panel, will be pressed downwardly against the action of the corresponding springs 134. Abutments 133 may be provided with stops to ensure that they cannot be tilted upwardly by their springs 134 beyond the position that is illustrated in respect to one of them at the top of FIG. 15 of the drawings. It will be seen from the various Figures of the drawings that, regardless of whether a single building section or a group of two or more such sections is being dealt with in the assembly station 100, the sections or groups of sections or units are each constantly in contact with at least one pair or abutments 133 or 215.

Figure 8:
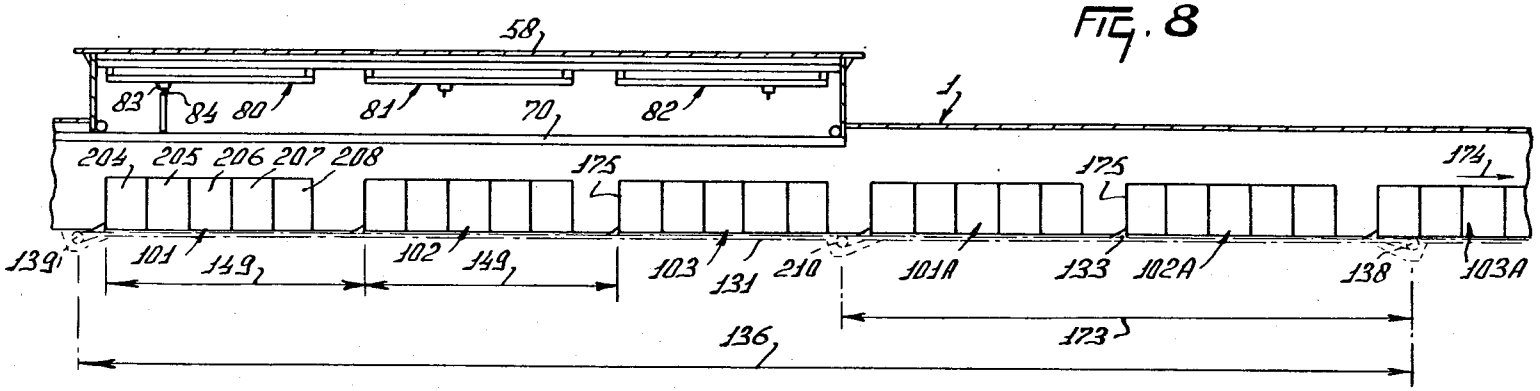
FIG. 8 is a section, to an enlarged scale, taken on the line VIII—VIII of FIG. 2.

The assembly part 5 of the production line 2 is provided throughout a length 170 (FIG. 2) thereof with a further pick-up conveying mechanism in the form of two chains 171 and 172 (FIGS. 9, 16 and 17 of the drawings) which chains are constructed and arranged in a substantially identical manner to the chains 130 and 131 so that a further detailed description thereof is unnecessary. The chains 171 and 172 are driven from a hydraulic motor 221, incorporating an accumulator, by way of a shaft 220. The shaft 220 has rollers or sprockets 211 at its opposite ends, the rollers or sprockets guide the chains between their upper operative runs and their lower return runs. Further rollers or sprockets 210 are provided at the opposite ends of the runs of the chains 171 and 172 that have just been mentioned at a location close to the delivery end of the assembly station 100 (see FIGS. 2, 8 and 9 of the drawings) The chains 171 and 172 overlap the chains 130 and 131 throughout a distance 212 (FIG. 2) which is approximately equal to half the distance 136 (FIG. 8). As previously mentioned, the chains 171 and 172 are constructed and arranged in substantially the same manner as the previously described chains 130 and 131 and are provided in the same way with abutments equivalent to the abutments 133 and 215.

Figure 16:
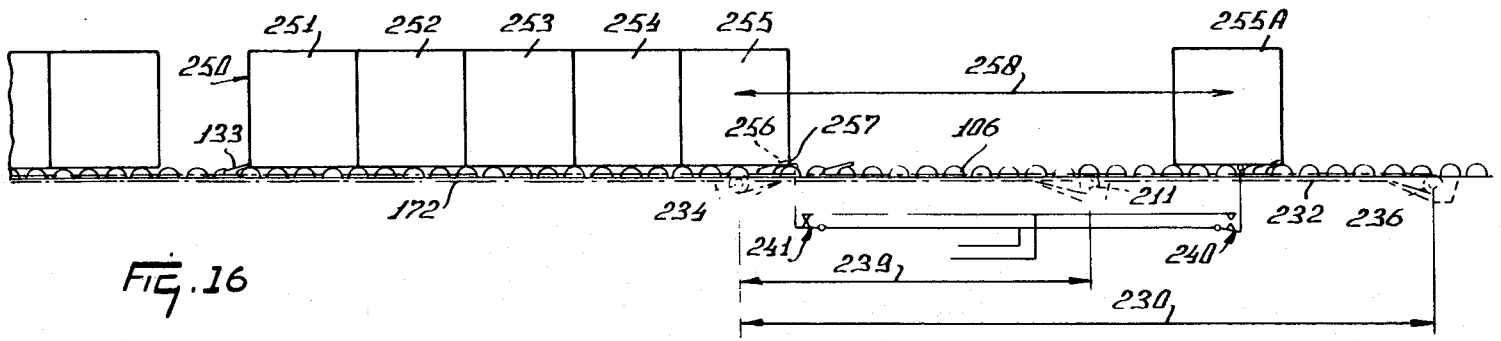
FIG. 16 is a diagrammatic side elevation illustrating a final part of the production line of which other parts are illustrated in FIGS. 1 and 2.

A high-speed conveying mechanism is arranged near the delivery or destination end of the assembly part 5 of the production line 2 throughout a distance 230 that is indicated in FIG. 16 of the drawings. The high-speed conveying mechanism which has just been mentioned comprises two conveying chains 231 and 232 which chains are again constructed and arranged in the same manner as the previously described chains 130 and 131. Rollers or sprockets 233 and 234 are arranged at the rear ends of the upper and lower runs of the chains 231 and 232 with respect to the direction 174 and said chains pass around, at the leading ends of their runs relative to said direction, further rollers or sprockets 235 and 236 that are carried at the opposite ends of a driving shaft 237 which is powered by a hydraulic motor 238 incorporating an accumulator. The chains 231 and 232 of the high-speed conveying mechanism overlap the chains 171 and 172 throughout a distance 239 which is indicated in FIG. 16 of the drawings. The hydraulic motor 221 which drives the chains 171 and 172 is electrically controlled by way of a circuit which incorporates two pairs of contacts 240 and 241 (FIG. 16 of the drawings) and the arrangement of said contacts is such that, when either or both of them are closed, the motor 221 drives the chains 171 and 172 by way of the shaft 220 whereas, when both pairs of contacts 240 and 241 are open, the motor is rendered inoperative and the chains are not driven.

In the use of the assembly part 5 of the production line 2, groups of building sections, such as the groups 101, 102 and 103, are formed from the completed panels in the assembly station 100 or, if preferred, are constructed individually in that station from the panels rather than in groups. Once each station or a group, or each individual section, is basically completed to the extent of comprising its floor panel 6, at least one of the wall panels 7 or 8 its ceiling or roof panel 9, then each such basically complete section is moved out of the assembly station 100 by the pick-up conveying mechanism that is afforded by the chains 130 and 131 and is carried through the aforementioned distance 170 (FIG. 2). The three groups of building sections 101, 102 and 103 that are shown, by way of example, in the accompanying drawings, are moved simultaneously out of the station 100 and arrive at locations in the assembly part 5 of the production line 2 that are indicated by the references 101A, 102A and 103A. It will be evident that the groups of sections do not move through the whole distance 170 immediately and it will be noted that, in fact, they are only displaced through a distance 173 approximately equal to half the distance 136 (FIG. 8) to bring them to the locations 101A, 102A and 103A. Abutments 133 or 215 are disposed behind each of the three groups of five building sections and, when they have been displaced to the locations 101A, 102A and 103A, space is left in the assembly station 100 for three further similar groups to be formed since the length in the direction 174 of the assembly station 100 is equal to approximately half the distance 136. When the groups have reached the locations which have just been mentioned, the chains 130 and 131 are brought to rest and are driven again only when further groups of building sections are completed in the station 100 and are ready to be moved on in the direction 174. The pick-up conveying mechanism that is afforded by the chains 130 and 131 is thus intermittently driven to move the groups of building sections out of the assembly station 100 on the supporting rollers of the roller track 104.

When the groups 101 and 103 of building sections reach the locations 101A to 103A, they become engaged by abutments 133 carried by the chains 171 and 172. Once again, said abutments 133 engage the rears of the groups 101 to 103 with respect to the direction 174, the upper runs of said chains 171 and 172 moving in that direction during an assembly operation to displace the groups in the same direction. During this displacement by the chains 171 and 172, the groups of sections are supported by the rollers of the tracks 106 to 109, it being noted that the guide rims 116 and 121 (FIGS. 10 and 11) act as stops preventing incorrect lateral displacements of the groups off the roller track 104. The chains 171 and 172 are driven continuously but at a very slow speed so that the groups of sections move slowly but uninterruptedly through the latter part of the distance 170. The speed of progress in the direction 174 of the groups of building sections is such that further operations can be performed upon them to bring them to a substantially completed condition by the time that they reach the end 176 of the assembly part 5 of the production line 2. For example, sanitary ware, cooking equipment, decorative wall finishes and the like can all be installed as the groups of sections are moved slowly forwards in the direction 174 by the continuously moving chains 171 and 172. It is also possible to install, where required, pipework, electrical conduits, floor tiles, ceiling tiles, various electrical appliances and even carpets may be laid. All these materials necessary for completing the sections can be brought to the same from the storage areas 177 and 178. The necessary materials can be brought into the areas 177 and 178 from the paths 179 and 180. When the building sections are used in the erection of a building, it is only necessary to fasten them permanently to one another, in place of the temporary fastenings employed to maintain the sections of each group in their correct relation one to the other, and, where required, to make connections to further building sections, foundations, roofing and the like. Such a building is substantially ready for immediate use once the various main services, waste pipes and the like have been connected.

As the groups of sections approach the end 176 of the assembly part 5 of the production line 2, they arrive within the reach of the high-speed conveying mechanism that is afforded principally by the chains 231 and 232. When, for example, a group 250 (FIGS. 16 and 17 of the drawings) of five prefabricated building sections 251, 252, 253, 254 and 255, arrives at the location which has just been mentioned, its leading section 255 with respect to the direction 174 is engaged by a pair of abutments 256 of the chains 231 and 232, which are appropriately driven at that time, said engagement taking place at the inner or rear (with respect to the direction 174) side of a leading (with respect to the same direction) beam 257 of the floor panel of the section 255. It should be noted that the beam 257 corresponds to one of the beams 12 or 13 (FIG. 3) of the previously described floor panel 6. The temporary connections between the sections 251 to 255 inclusive of the group 250 will have been released shortly before the group 250 arrives at the beginning, in the direction 174, of the chains 231 and 232 so that the abutments 256 are able to move the section 255 quickly onwards in the direction 174 to bring it into forwardly spaced relationship, in that direction, from the other sections 251 to 254 inclusive. When the rapidly displaced section 255 reaches the location indicated by the reference 255A in FIGS. 16 and 17 of the drawings, the hydraulic motor 238 driving the chains 231 and 232 is switched off either manually or automatically so that the finished and separated section 255 can be removed from the location 255A for transport to a storage facility or, possibly, direct to a building site. The section 255 is displaced rapidly by the chains 231 and 232 through a distance 258 (FIG. 16) and the time taken to do this and to remove the section in question from the location 255A is usually equal to the time taken by the slowly moving chains 171 and 172 to advance the next section 254 into the plane previously occupied by the section 254 before its rapid displacement by the chains 231 an 232. When the location 255A is clear and the next section 254 has reached the position shown for the section or unit 255 in FIGS. 16 and 17 of the drawings, the hydraulic motor 238 is again driven to advance the section 254 quickly in the direction 174 and repeat the operation that has just been described for the section 255.

It will be noted from FIG. 16 of the drawings that, when any section reaches the location 255A, its weight opens the pair of contacts 240. Similarly, when any section occupies the position indicated for the section 255 in FIGS. 16 and 17 of the drawings, its weight opens the contacts 241. Thus, if a section, such as the section or unit 254, reaches the beginning, in the direction 174, of the chains 231 and 232 and opens the pair of contacts 241 while the previous section such as the section 255, still occupies the location 255A, then both pairs of contacts 240 and 241 will be opened and, as previously indicated, the hydraulic motor 221 cannot operate an there is no danger of a second section, such as the section or unit 254, being rapidly advanced by the chains 231 and 232 until the section occupying the location 255A has been removed thus allowing the contacts 240 to close. Only when the contacts 240 are again closed can the slowly moving chains 171 and 172 be driven again to advance the next section or unit, such as the section 254, to a point at which it will be engaged by a pair of the rapidly moving abutments 256. A factory which employs the method of construction and assembly that has been described enables prefabricated building sections or room units to be manufactured very rapidly. The initial panels are made in the way which has been described on the manufacturing part 4 of the production line 2 and are conveyed quickly and simply to the drying areas 86 and 87 which also serve as storage areas. The building sections or room units themselves are assembled from the completed panel in the part 5 of the production line 2, the conveyance of the panels from the manufacturing part 4 of the line 2 being performed in a direction that is substantially parallel to the conveyance of the basically completed sections on the part 5 of the line 2. The panels are conveyed from the drying areas or storage areas 86 and 87 to the assembly station 100 in directions that are substantially perpendicularly transverse to the direction 174.

When a panel that has been made in the manufacturing part 4 of the production line 2 has to be lifted from its jig by the hoist of one of the crane bridges 72, such lifting is greatly facilitated by tilting the jig concerned into an upwardly inclined position in the manner shown in FIGS. 6 and 7 of the drawings. Such tilting greatly minimizes the risk of damage to the completed panels. One jig 73 is shown by way of example in FIG. 6 of the drawings and it will be seen that it is pivotable about a horizontal axis that is located at one of its ends and that extends parallel to the direction 174. The opposite end of the jig 73 is pivotally connected to a hydraulic piston and cylinder unit or ram 74, and, upon extension of said unit or ram 74, the jig is tilted upwardly about the axis which has just been mentioned to bring it to the position thereof that is shown in FIG. 6 of the drawings. The upper end of the panel that is located in the jig can then be carefully engaged by the hoist that is carried by the trolley 71 of one of the crane bridges 72 and said hoist can then be raised and the completed panel carried away in a vertical position as shown in FIG. 7 of the drawings. The panel will be moved to one of the drying areas 86 or 87 or to the drying region 58. Once the completed panel has been removed from the jig 73, its piston and cylinder assembly or ram 74 is retracted to bring it back to a horizontal position ready for the making of another panel.

It has been found that three groups of building sections that each comprise five such sections (i.e. a total of fifteen sections) can be assembled in the station 100 in an average time of about four hours. This period of about one-half working day is particularly advantageous because it means that, in a lunch period or other interval between two such half day sessions, a first completed batch of three groups of sections can be moved out of the assembly station 100 and on to the region of the part 5 of the line 2 in which finishing operations are undertaken while further panels can be supplied to the empty assembly station 100 for assembly during the next four hour working period. The distance 170 (FIG. 2) is such that it will hold three and one-third times the number of building sections that can be accommodated in the assembly station 100. The time that is given for finishing the basically completed sections after their assembly in the station 100 is therefore of sufficient duration.

Although various steps in the methods that have been described or illustrated in the accompanying drawings and various features of the factory that has been described or illustrated in the accompanying drawings will be set forth in the following claims as inventive features, it is emphasized that the invention is not necessarily limited to those steps or features and includes within its scope each step in the methods described or illustrated in the accompanying drawings and each feature of the factory described or illustrated in the accompanying drawings both individually and in various combinations.

I claim:

1. A method for the manufacture of prefabricated building sections on a production line, the method comprising the steps of fabricating panels along a manufacturing line of said production line, assembling prefabricated panels in an assembly station of said line into basically completed structural sections which comprise at least an assembled floor, two walls and ceiling or roof and employing an intermittently movable conveying mechanism which moves said structural sections from said assembly station to an assembly part of said line, continuously moving said structural sections through at least a substantial portion of said assembly part, and performing finishing operations on said structural sections in said assembly part of said production line.

2. A method as claimed in claim 1, wherein the step of assembling prefabricated panels in the assembly station comprises assembling those panels to form said structural sections in an adjoining group relationship, each such group comprising at least two structural sections.

3. A method as claimed in claim 2, wherein the step of assembling a said structural section in said assembly station comprises first disposing a floor panel in its appointed position, subsequently erecting wall panels thereon and thereafter mounting a ceiling or roof panel on said wall panels.

4. A method as claimed in claim 3, wherein said structural sections of said groups assembled in said assembly station are retained in interconnected relationship throughout at least some of their movement through said assembly part of said production line.

5. A method as claimed in claim 4, comprising the step of disconnecting said sections of said groups from one another towards the destination end of said assembly part of said production line and subsequently removing the individual disconnected sections from that line one at a time in order of their arrival proximate said destination end.

6. A method as claimed in claim 5, wherein said disconnected sections are brought into spaced relationship from one another proximate said destination end of said assembly part of said production line by the use of an intermittently operating conveying mechanism which, when in use, displaces said sections at an increased speed towards a location at said destination end from which said location said sections are finally removed from said production line.

7. A method as claimed in claim 1, wherein materials and items of equipment are supplied to said structural sections on the assembly part of said production line from storage facilities located alongside that part, said materials and items of equipment being employed in the finishing of the sections.

8. A method as claimed in claim 7, wherein each said section is of oblong configuration when seen in plan view, having longer and shorter sides, the direction of movement of each said section along said assembly part of said production line being substantially parallel to the shorter sides thereof.

9. A method as claimed in claim 1, wherein said assembly part of the production line is substantially straight between the assembly station and the destination end of that line.

10. A method as claimed in claim 1, wherein the prefabricated panels from which said structural sections are assembled are provided to said assembly station in at least one direction that is transverse to the length of said assembly part of said production line.

11. A method as claimed in claim 1, wherein said prefabricated panels are provided by conveyor lines to said assembly station from two opposite sides of said station.

12. A method as claimed in claim 11, wherein said panels are provided to said assembly station from storage areas in which areas some drying, setting or hardening of the material of said panels takes place.

13. A method as claimed in claim 12, wherein said panels are made in a manufacturing part of said production line and are conveyed from that part to at least one storage area adjacent said assembly station.

14. A method as claimed in claim 13, wherein said panels are moved to said storage area by conveying members arranged to move over and above said manufacturing part of said production line.

15. A method as claimed in claim 14, wherein said panels are moved from said storage area to said assembly station by means of said conveying members for said panels.

16. A method as claimed in claim 15, wherein said panels are made in jigs provided along said manufacturing part of said production line.

17. A method as claimed in claim 16, wherein at least some of said panels are formed pricipally from slabs of castable material, and wherein a metal beam is provided along at least one edge of each such slab.

18. A method as claimed in claim 17, wherein said castable material is concrete.

19. A method as claimed in claim 18, wherein means is provided for heating said castable material and said material is conveyed to casting jigs in said manufacturing part in a hot condition.

20. A method as claimed in claim 17, wherein said concrete is prepared in a mixing area and is provided said manufacturing part of said production line by a conveyor belt, further conveying means being provided for moving the castable material from the conveyor belt to individual and casting jigs of said manufacturing part.

21. A method as claimed in claim 17, wherein at least some of said jigs in which at least parts of the panels are cast are provided with means for moving them from substantially horizontal positions into substantially vertical positions, and wherein, after a panel has hardened to an extent sufficient to permit its removal from the corresponding jig, that jig is brought to its substantially vertical position and the panel is engaged by conveying means so that it may be transported in a substantially vertical position by that conveying means from said manufacturing part of said production line to said storage area.

22. A method as claimed in claim 13, wherein said floor panels and ceiling or roof panels are transported from said manufacturing part of said production line to said storage area in dispositions which are substantially identical to those in which they were cast.

23. A method as claimed in claim 13, wherein at least some of said panels are provided on said manufacturing part of said production line with corresponding frames, said frames being made in at least one jig in a construction part of said production line.

24. A method as claimed in claim 23, wherein said frames are formed from metal beams which are welded together in said jig.

25. A method as claimed in claim 24, wherein said metal beams are subject to an antioxidizing treatment prior to their use in said jig in which said prefabricated panels are made.

26. A method as claimed in claim 25, wherein said antioxidizing treatment is effected by dipping said metal beams in at least one bath of a liquid oxidizing protective agent.

27. A method as claimed in claim 1 comprising the initial step of manufacturing panels for the floors of said sections of concrete material cast within a framework of metal beams which is incorporated in each said floor panel as its outer periphery, and subsequently utilizing said frameworks of metal beams in moving said structural sections by said conveying mechanism whereby said framework is employed for the connection between said conveying mechanism and each said section.

28. A method for the manufacture of prefabricated building sections on a production line, the method comprising the steps of fabricating panels along a manufacturing line of said production line, connecting a plurality of floor panels in an assembly station of said line, mounting at least two wall panels on each said floor panel, and connecting ceiling or roof panels to said wall panels above each of said floor panels whereby a plurality of basically completed structural sections are produced in said assembly station of said line and are connected together in the relationship which they will have in the completed building, intermittently moving said connected structural sections from said assembly station to an assembly part of said line by employing an intermittently movable conveying mechanism, continuously moving said structural sections through at least a substantial portion of said assembly part, and performing finishing operations on said connected structural sections in said assembly part of said line.

29. A method for the manufacture of prefabricated building sections in a production line, the method comprising the steps of fabricating panels along a manufacturing line of said production line, assembling a plurality of floor, wall and ceiling or roof panels into a group of basically completed structural sections in said assembly station of said line, assembling a further plurality of floor, wall and ceiling or roof panels into a further group of connected basically completed structural sections in said assembly station of said line so that at least two said groups are concurrently in said assembly station of said line, intermittently moving said groups simultaneously from said assembly station into an assembly part of said line by employing an intermittently movable conveying mechanism, performing finishing operations on said groups in said assembly part of said production line.

30. A method for the manufacture of prefabricated building sections on a production line, the method comprising the steps of assembling prefabricated panels in an assembly station of said line into basically completed structural sections which comprise at least an assembled floor, two walls and ceiling or roof, intermittently moving said structural sections from said assembly station to an assembly part of said line by employing an intermittently movable conveying mechanism, continuously moving said structural sections through at least a substantial portion of said assembly part, performing finishing operations on said structural sections in said assembly part of said line, providing at the end of said portion through which said structural sections are moved continuously, a relatively high speed mechanism, rapidly displaced each said section from said portion by said high speed conveying mechanism and transporting same thereby to the end of said production line from where each said section is transported to a selected designation.

31. A method for the manufacture of prefabricated building sections on a production line, the method comprising the steps of making prefabricated floor, wall and ceiling or roof panels and transporting same to adjacent opposite sides of an assembly station in said line and further transporting said panels from said opposite sides of said assembly station to said assembly station, assembling said prefabricated panels in said assembly station of said line into basically completed structural sections which comprise at least an assembled floor, two walls and a ceiling or roof, and employing an intermittently movable conveying mechanism which moves said structural sections from said assembly station to an assembly part of said line, continuously moving said structural sections through a substantial portion of said assembly part of said line, and performing finishing operations on said structural sections in said assembly part of said line.

32. A method for the manufacture of prefabricated building sections on a production line, the line consisting of a manufacturing part, an assembly station and an assembly part, the method comprising the steps of making prefabricated floor, wall and ceiling or roof panels on manufacturing parts of said production line, moving said prefabricated floor, wall and ceiling or roof panels along said manufacturing parts of said production line parallel to said assembly station and said assembly line, transporting said panels to an assembly station of said line, assembling said prefabricated panels in said assembly station into basically completed structural sections which comprise at least an assembled floor, two walls and ceiling or roof, intermittently moving said structural sections from said assembly station to an assembly part of said line by employing an intermittently movable conveying mechanism, continuously moving said structural sections through at least a substantial portion of said assembly part, and performing finishing operations on said structural sections in said assembly part of said line.

* * * * *